United States Patent [19]

Otomine et al.

[11] 4,142,929

[45] Mar. 6, 1979

[54] PROCESS FOR MANUFACTURING TRANSFER SHEETS

[76] Inventors: Kazuo Otomine, 533, Sanjo-cho, Takamatsu-shi, Kagawa-ken; Mototsugu Matsuo, 4-36, Nishi 2-chome, Nakazaki, Kita-ku, Osaka-shi, both of Japan

[21] Appl. No.: 873,535

[22] Filed: Jan. 30, 1978

[51] Int. Cl.[2] ..... B44C 3/02

[52] U.S. Cl. ..... 156/72; 156/230; 156/234; 156/239; 156/240; 156/276; 156/277; 156/280; 156/283; 427/148; 427/196; 427/197; 427/200; 427/202; 427/206; 428/88; 428/90; 428/297; 428/327; 428/347; 428/354; 428/914

[58] Field of Search ..... 156/72, 230, 234, 239, 156/240, 276, 283, 299, 277, 280; 428/40, 88, 90, 297, 327, 343, 346, 347, 354, 914, 323; 427/196, 197, 200, 202, 206, 207 A, 180, 147, 148

[56] References Cited

U.S. PATENT DOCUMENTS

| | | | |
|---|---|---|---|
| 2,008,763 | 7/1935 | Lawrence et al. | 427/148 |
| 2,283,480 | 5/1942 | Wilkerson | 428/88 |
| 2,872,365 | 2/1959 | de Bruyne et al. | 156/283 |
| 3,379,604 | 4/1968 | Weber et al. | 428/90 |
| 3,684,637 | 8/1972 | Anderson et al. | 428/90 |
| 3,837,946 | 9/1976 | Gribbin | 156/72 |
| 3,956,552 | 5/1976 | Geary | 428/88 |
| 4,004,061 | 1/1977 | Creighton et al. | 427/207 A |
| 4,037,008 | 7/1977 | Tugwell | 427/148 |

*Primary Examiner*—Jerome W. Massie

*Attorney, Agent, or Firm*—Wenderoth, Lind & Ponack

[57] ABSTRACT

A process for manufacturing transfer sheets is disclosed in which short fibers are temporarily stuck to a base sheet to form a short fiber layer to which two kinds of adhesives are applied to a desired design or letter to be transferred. When the transfer sheet thus made is put on a clothes or the like and heat and pressure are applied, the short fibers are transferred to the clothes only where coated with the adhesive.

3 Claims, 3 Drawing Figures

PROCESS FOR MANUFACTURING TRANSFER SHEETS

The present invention relates to a process for manufacturing transfer sheets for transferring a design or letter to a surface of clothes, hat, bag, etc.

Transfer sheets are known which have a base sheet coated as by printing with a thermoplastic material as synthetic resin to a design or letter to be transferred by application of heat. With such conventional transfer sheets, it was difficult to transfer multicolor designs and a mere application of the thermoplastic material produced only designs lacking three-dimensional effect.

An object of the present invention is to provide a process for manufacturing transfer sheets with which tasteful designs or letters having a three-dimensional effect which can be transferred.

Another object of the present invention is to provide a process for manufacturing transfer sheets with which multicolor patterns or letters of any shape can be transferred.

A further object of the present invention is to provide a process for manufacturing transfer sheets with which short fibers can be transferred to clothes or the like in such a manner as not to easily come off.

The present invention consists in a process for manufacturing transfer sheets comprising the steps of forming on the surface of a base sheet an adhesive layer for temporary adhesion of short fibers, temporarily sticking short fibers to said adhesive layer to form a short fiber layer, applying an adhesive in the form of emulsion or solution to said short fiber layer to a desired pattern to form a transfer adhesive layer, said adhesive retaining elasticity after curing, and applying a heat-sensitive adhesive in a powdery form to said transfer adhesive layer before the transfer adhesive has cured.

The transfer sheet thus made is put on clothes, for example, with the heat-sensitive adhesive layer down. By application of pressure and heat through the base sheet, the heat-sensitive adhesive layer will melt, adhering to the clothes. When the base sheet is taken off after heating, the short fiber layer is peeled off the base sheet and transferred to the clothes only where it is covered with the heat-sensitive adhesive layer.

The short fiber layer may be formed on the whole surface of the base sheet or to the desired pattern or letter with or without some margin to save the amount of material. This can be carried out by applying the adhesive to the shape of desired pattern or using a template to temporarily stick the short fibers. Conveniently, the short fiber layer should be formed to be slightly larger than the desired pattern or letter or with some margin or allowance to facilitate the succeeding work.

The short fibers to be temporarily stuck to the base sheet may be of any color. Short fiber of white or any other light color may be used and colored to any other color before the formation of transfer adhesive layer by spraying, roll coating, hand painting, or some suitable printing process. This enables multicolor patterns to be transferred.

The base sheet employed in this invention may be any material which is compatible with the adhesive used for temporary adhesion of the short fiber and which is not affected by the pressure and heat applied for transference. Among them are papers, processed paper, resin sheet, and metal foils.

As adhesives for temporary adhesion, any adhesives may be used which can stick short fibers to the base sheet and tends to be absorbed to the short fiber or the base sheet. It may be an adhesive in the form of solution or emulsion such as a resin or its copolymer such as polyvinyl acetate, polyvinyl alcohol, polyvinyl chloride, polyvinyl butyral, acrylic resin, polyurethane, polyester, polyamides, or cellulose derivatives, rubber derivatives, or starch, casein, dextrin, gum arabic, carboxy methyl cellulose, rosin, or compositions containing two or more of these ingredients.

The amount of such adhesive for temporary adhesion is not perticularly limited unless it is too much for the short fibers to be peeled off the base sheet. We found that 200 grams of wet adhesive per square meter adequate to transfer the short fiber.

The short fibers employed in this invention may be rayon, polyamide or other synthetic fiber or cotton having a length of the order of 0.5 to 3.0 mm.

The transfer adhesive applied on the short fiber layer may be any adhesive which remains elastic even after curing. An adhesive in the form of solution or emulsion may be used which contain a resin such as polyvinyl chloride, polyvinyl acetate, acrylic resin, polyurethane, polyester, polyamide.

The heat-sensitive adhesive used in this invention may be an adhesive containing one or more selected from the group consisting of polyvinyl chloride, thermoplastic acrylic resin, polyethylene, polyamide, polyester, paraffin, rubber derivative and dammar rubber.

The short fibers may be temporarily attached to the whole surface of the adhesive as by spraying, sprinkling or electrostatic process.

When the transfer sheet thus made is put on e.g. the clothes to be transfered on with the heat-sensitive adhesive layer down and pressure and heat are applied thereto, the short fibers easily get off the base sheet since the adhesive for temporary adhesion is small in amount and is absorbed to the short fibers upon application of heat. On the other hand, the heat-sensitive adhesive softens by heat and permiates into the clothes. The transfer adhesive layer stays in the form of a film, preventing the softened heat-sensitive adhesive from moving toward the short fibers. The heat-sensitive adhesive, which has stuck to the transfer adhesive layer, sticks the short fibers tightly to the clothes. Thus, when the base sheet is peeled off the clothes after application of pressure and heat, the short fibers covered with the transfer adhesive layer will separate off the base sheet. Now, the desired pattern or letter has been transferred to the clothes.

As mentioned before, the transfer adhesive layer stays elastic in the form of film after transference. Thus, it is easily adaptable to any elongation or deformation of the clothes without undue stress. The design thus transferred serve as an almost permanent decoration or indication without deforming or getting off the clothes. Since such design or letter is made from short fibers in layers, it has flexibility, gracefulness and a three-dimensional effect. Any complicated pattern or letter can also be easily formed merely by applying a transfer adhesive in the form of solution or emulsion to the short fiber layer to such a pattern, by screen or gravure printing. The short fiber layer can also be colored by printing. This makes it possible to transfer any multicolor complicated pattern.

Since a heat-sensitive adhesive in a powdery form is used, the heat-sensitive adhesive layer will have a rough surface. This is advantageous in bringing the pattern to a correct position on the clothes. This also helps the heat-sensitive adhesive permiate into any niches in the clothes, thus assuring fast adhesion.

The pressure applied for transference is preferably 50 g/cm$^2$ to 20 kg/cm$^2$, and the time for pressure application is preferably 5 to 60 seconds. The temperature for transference has only to be sufficient to soften the heat-sensitive adhesive.

The present invention will be described with reference to the following examples and accompanying drawings, in which.

The following example, which is merely illustrative, will show how the process of the present invention may be practised.

Figure 1:
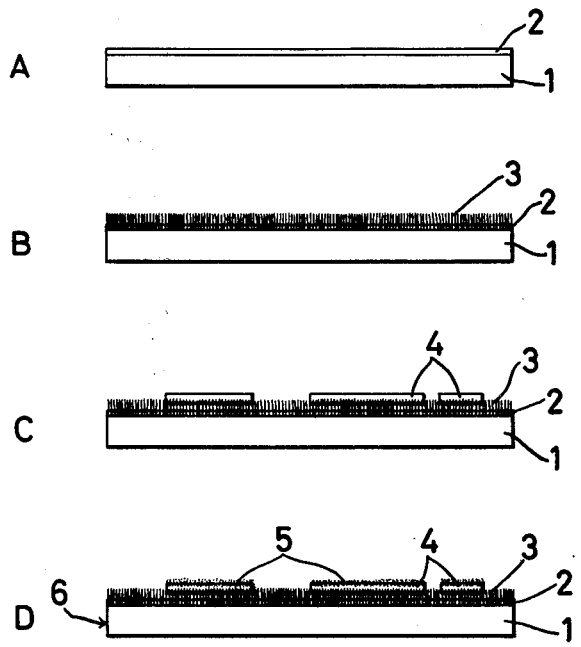
FIGS. 1A to 1D are front views showing various steps of the first embodiment of the process according to this invention.

FIGS. 1A to 1D illustrate the first embodiment of this invention. A sheet of fine paper (150 gram/m$^2$) as the base sheet 1 was coated over its whole surface with polyvinyl acetate series adhesive in the form of emulsion (having a solid content of 30%) by knife edge coating process for a thickness of about 200 gram/m$^2$ (in a wet state) to form an adhesive layer 2 for temporary adhesion of short fiber. (FIG. 1A)

Rayon pile cut to a length of 0.8 mm was then stuck to the whole surface of the adhesive layer 2 by the electrostatic process to form a short fiber layer 3. (FIG. 1B) Although in the figure the short fibers stand up uniformly, they are actually adhered one upon another in the form of layer.

An acrylic resin emulsion was then applied to the surface of the short fiber layer 3 to a desired pattern by a silk screen printing process to form a transfer adhesive layer 4 on part of the short fiber layer. (FIG. 1C) Before the transfer adhesive has cured, ethylene-vinyl acetate copolymer in a powdery form was sprinkled on the transfer adhesive layer to form a heat-sensitive adhesive layer 5 of the same shape and the same size as the transfer adhesive layer 4. This made a transfer sheet 6. (FIG. 1D)

Figure 2:
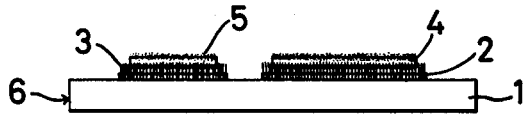
FIG. 2 is a similar view of the second embodiment.

FIG. 2 shows a second embodiment in which a polyvinyl acetate adhesive (having a solid content of 30%) was applied on the base sheet 1 to a desired pattern, but of a slightly larger size, by silk screen printing to form an adhesive layer 2 for temporary adhesion. Then, the same procedure as in the first embodiment was used to obtain a transfer sheet 6.

As another embodiment, short fibers of white color, for example, may be used to form a short fiber layer 3, which is colored to a desired pattern as by printing. The subsequent procedure may be the same as in the first embodiment.

Figure 3:
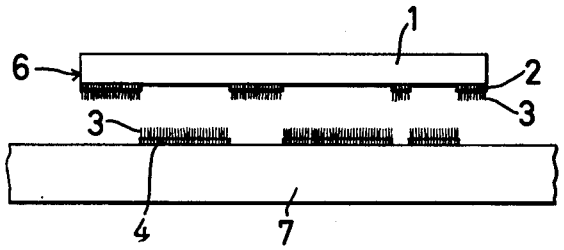
FIG. 3 is a front view showing how the tranfer sheet made by the first embodiment is transferred.

The transfer sheet 6 thus made is turned upside down and put on the clothes 7, for example. After heat and pressure have been applied to the transfer sheet, the base sheet 1 is peeled off. As shown in FIG. 3, the short fiber layer 3 where coated with the transfer adhesive will be transferred to the clothes 7 with the short fiber layer not coated therewith remaining on the base sheet. The second embodiment can reduce the amount of such short fibers remaining on the base sheet, thus wasted.

What are claimed are:

1. A process for manufacturing transfer sheets comprising the steps of:

forming on the surface of a base sheet an adhesive layer for temporary adhesion of short fibers, to the base sheet, temporarily sticking short fibers to said adhesive layer to form a short fiber layer, applying an adhesive in the form of emulsion or solution in said short fiber layer to a desired pattern to form a transfer adhesive layer, bonding the upper part of said fibers in said pattern said adhesive retaining elasticity after curing, and applying a heat-sensitive adhesive in powdery form to said transfer adhesive layer before the transfer adhesive has cured.

2. A process for manufacturing transfer sheets as claimed in claim 1 wherein the short fiber layer is formed in a pattern slightly larger than said desired pattern.

3. A process for manufacturing transfer sheets as claimed in claim 1 or 2 wherein short fibers of a light color are used to form said short fiber layer and are colored after formation of said short fiber layer to at least one other color.

* * * * *